US011047220B2

(12) United States Patent
Bhatnagar

(10) Patent No.: US 11,047,220 B2
(45) Date of Patent: Jun. 29, 2021

(54) REAL-TIME OPTIMIZATION OF STIMULATION TREATMENTS FOR MULTISTAGE FRACTURE STIMULATION

(71) Applicant: HALLIBURTON ENERGY SERVICES, INC., Houston, TX (US)

(72) Inventor: Ankit Bhatnagar, Pune (IN)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 183 days.

(21) Appl. No.: 16/473,920

(22) PCT Filed: Jan. 31, 2017

(86) PCT No.: PCT/US2017/015759
§ 371 (c)(1),
(2) Date: Jun. 26, 2019

(87) PCT Pub. No.: WO2018/143918
PCT Pub. Date: Aug. 9, 2018

(65) Prior Publication Data

US 2021/0131251 A1 May 6, 2021

(51) Int. Cl.

| | |
|---|---|
| ***E21B 43/26*** | (2006.01) |
| ***E21B 47/06*** | (2012.01) |
| ***E21B 49/08*** | (2006.01) |
| ***E21B 43/267*** | (2006.01) |
| ***E21B 49/00*** | (2006.01) |

(52) U.S. Cl.
CPC ..... *E21B 43/267* (2013.01); *E21B 43/261* (2013.01); *E21B 47/06* (2013.01); *E21B 49/006* (2013.01); *E21B 49/0875* (2020.05); *E21B 2200/20* (2020.05)

(58) Field of Classification Search
CPC ..... E21B 43/261; E21B 43/267; E21B 47/06; E21B 49/006; E21B 49/0875; E21B 2200/20; E21B 41/00; E21B 41/0092
See application file for complete search history.

(56) References Cited

U.S. PATENT DOCUMENTS

| | | | |
|---|---|---|---|
| 5,054,554 | A | 10/1991 | Pearson |
| 7,451,812 | B2 | 11/2008 | Cooper et al. |
| 8,855,988 | B2 | 10/2014 | Strobel et al. |
| 2005/0241855 | A1 | 11/2005 | Wylie et al. |

(Continued)

FOREIGN PATENT DOCUMENTS

| | | | |
|---|---|---|---|
| WO | 2010068128 | A1 | 6/2010 |
| WO | 2014158427 | A1 | 10/2014 |

(Continued)

OTHER PUBLICATIONS

International Search Report and Written Opinion; PCT Application No. PCT/US2017/015759; dated Oct. 24, 2017.

*Primary Examiner* — Matthew R Buck
(74) *Attorney, Agent, or Firm* — Polsinelli PC

(57) ABSTRACT

Systems and methods for real-time optimization of stimulation treatments in a hydrocarbon reservoir by controlling a simulated stimulation treatment schedule for a main fracture stimulation treatment stage using a predicted net pressure in a cluster of fractures representing a dominant fracture for the main fracture stimulation treatment stage.

20 Claims, 4 Drawing Sheets

(56) References Cited

U.S. PATENT DOCUMENTS

| | | | | |
|---|---|---|---|---|
| 2006/0015310 | A1* | 1/2006 | Husen | E21B 43/26 703/10 |
| 2011/0257944 | A1* | 10/2011 | Du | E21B 43/267 703/2 |
| 2012/0043085 | A1 | 2/2012 | Willberg | |
| 2012/0179444 | A1* | 7/2012 | Ganguly | E21B 43/26 703/10 |
| 2013/0140020 | A1 | 6/2013 | Suarez Rivera et al. | |
| 2013/0341030 | A1 | 12/2013 | Brannon et al. | |
| 2014/0262232 | A1* | 9/2014 | Dusterhoft | E21B 43/26 166/250.1 |

FOREIGN PATENT DOCUMENTS

| | | | |
|---|---|---|---|
| WO | 2015126799 | A2 | 8/2015 |
| WO | 2018022044 | A1 | 2/2018 |
| WO | 2018022045 | A1 | 2/2018 |

* cited by examiner

REAL-TIME OPTIMIZATION OF STIMULATION TREATMENTS FOR MULTISTAGE FRACTURE STIMULATION

CROSS-REFERENCE TO RELATED APPLICATIONS

This application is a national stage entry of PCT/US2017/015759 filed Jan. 31, 2017, said application is expressly incorporated herein in its entirety.

FIELD OF THE DISCLOSURE

The present disclosure generally relates to systems and methods for real-time optimization of stimulation treatments for multistage fracture stimulation. More particularly, the present disclosure relates to real-time optimization of stimulation treatments in a hydrocarbon reservoir by controlling a simulated stimulation treatment schedule for a main fracture stimulation treatment stage using a predicted net pressure in a cluster of fractures representing a dominant fracture for the main fracture stimulation treatment stage.

BACKGROUND

In the oil and gas industry, a well that is not producing as expected may need stimulation to increase the production of subsurface hydrocarbon deposits, such as oil and natural gas. Hydraulic fracturing is a type of stimulation treatment that has long been used for well stimulation in unconventional reservoirs. A multistage stimulation treatment operation may involve drilling a lateral wellbore and injecting treatment fluid into a surrounding formation in multiple stages via a series of perforations or formation entry points along a path of a wellbore through the formation. During each of the stimulation treatment, different types of fracturing fluids, proppant materials (e.g., sand), additives and/or other materials may be pumped into the formation via the entry points or perforations at high pressures to initiate and propagate fractures within the formation to a desired extent. With advancements in lateral well drilling and multistage hydraulic fracturing of unconventional reservoirs, there is a greater need for ways to accurately monitor the downhole flow and distribution of injected fluids across different clusters of fractures and efficiently deliver treatment fluid into the subsurface formation.

Diversion is a technique used in injection treatments to facilitate uniform distribution of treatment fluid over each stage of the treatment. Diversion may involve the delivery of a diverting agent into the wellbore to divert injected treatment fluids toward formation entry points along the wellbore path that are receiving inadequate treatment. Examples of different diverting agents include, but are not limited to, viscous foams, particulates, gels, benzoic acid and other chemical diverters. Traditionally, operational decisions related to the use of diversion technology for a given treatment stage, including when and how much diverter is used, are made a priori according to a predefined treatment schedule. Such conventional diversion techniques therefore, fail to consider the parameters of a successfully diverted main fracture stimulation treatment stage before determining the next main fracture stimulation treatment schedule.

BRIEF DESCRIPTION OF THE DRAWINGS

The present disclosure is described below with references to the accompanying drawings in which like elements are referenced with like reference numerals, and in which.

DESCRIPTION OF THE ILLUSTRATIVE EMBODIMENTS

Figure 1:
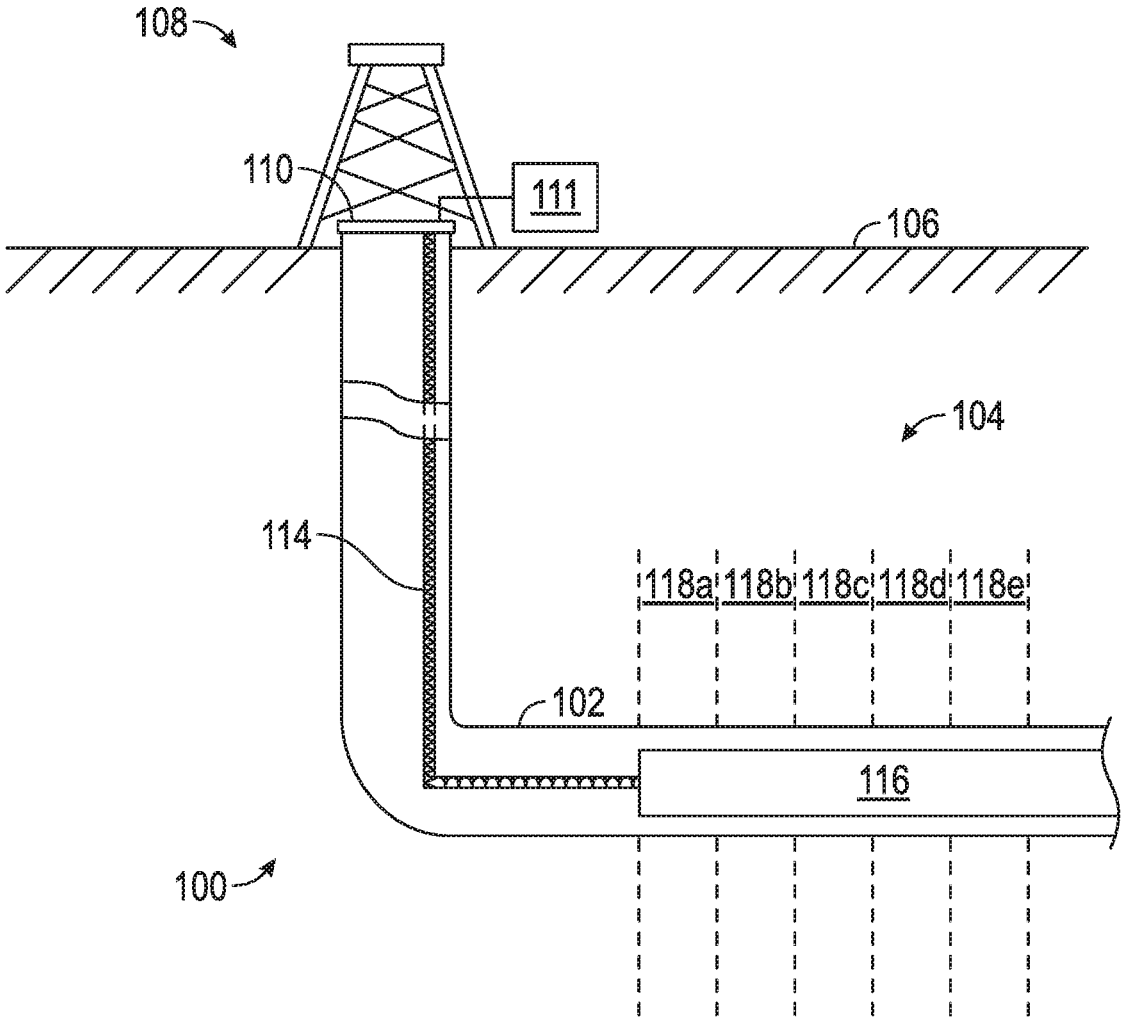
FIG. 1 is a schematic diagram illustrating a well system for multistage fracture stimulation treatment in a hydrocarbon reservoir.

The subject matter of the present disclosure is described with specificity, however, the description itself is not intended to limit the scope of the disclosure. The subject matter thus, might also be embodied in other ways, to include different structures, steps and/or combinations similar to and/or fewer than those described herein, in conjunction with other present or future technologies. Although the term "step" may be used herein to describe different elements of methods employed, the term should not be interpreted as implying any particular order among or between various steps herein disclosed unless otherwise expressly limited by the description to a particular order. Other features and advantages of the disclosed embodiments will be or will become apparent to one of ordinary skill in the art upon examination of the following figures and detailed description. It is intended that all such additional features and advantages be included within the scope of the disclosed embodiments. Further, the illustrated figures are only exemplary and are not intended to assert or imply any limitation with regard to the environment, architecture, design, or process in which different embodiments may be implemented.

The present disclosure overcomes one or more deficiencies in the prior art by real-time optimization of stimulation treatments in a hydrocarbon reservoir by controlling a simulated stimulation treatment schedule for a main fracture stimulation treatment stage using a predicted net pressure in a cluster of fractures representing a dominant fracture for the main fracture stimulation treatment stage.

In one embodiment, the present disclosure includes a method for optimization of stimulation treatments for a main fracture stimulation treatment stage, which comprises: measuring values for i) a fluid flow allocation for each cluster of fractures associated with the main fracture stimulation treatment stage using fiber optic sensors and a surface pressure profile; and ii) tortuosity and friction pressure losses across each cluster of fractures; calibrating a fracture model by iteratively simulating values for i) the fluid flow allocation for each cluster of fractures associated with the main fracture stimulation treatment stage and the surface pressure profile; and ii) the tortuosity and friction pressure losses across each cluster of fractures until a difference in the simulated values and the respective measured values is within a predetermined margin of error; simulating an initial treatment schedule for the main fracture stimulation treatment stage using the calibrated fracture model and one or more initial treatment schedule parameters; calculating a predicted net pressure value for each cluster of fractures using one of the simulated initial treatment schedule and an updated treatment schedule; updating the simulated initial treatment schedule until a difference between the predicted net pressure value for a cluster of fractures representing a dominant fracture and a predetermined net pressure value for a cluster of fractures representing another dominant fracture is within another predetermined margin of error, which represents a last updated treatment schedule; and performing the main fracture stimulation treatment stage based on the last updated treatment schedule.

In another embodiment, the present disclosure includes a non-transitory program carrier device tangibly carrying computer executable instructions for optimization of stimulation treatments for a main fracture stimulation treatment stage, the instructions being executable to implement: measuring values for i) a fluid flow allocation for each cluster of fractures associated with the main fracture stimulation treatment stage using fiber optic sensors and a surface pressure profile; and ii) tortuosity and friction pressure losses across each cluster of fractures; calibrating a fracture model by iteratively simulating values for i) the fluid flow allocation for each cluster of fractures associated with the main fracture stimulation treatment stage and the surface pressure profile; and ii) the tortuosity and friction pressure losses across each cluster of fractures until a difference in the simulated values and the respective measured values is within a predetermined margin of error; simulating an initial treatment schedule for the main fracture stimulation treatment stage using the calibrated fracture model and one or more initial treatment schedule parameters; calculating a predicted net pressure value for each cluster of fractures using one of the simulated initial treatment schedule and an updated treatment schedule; updating the simulated initial treatment schedule until a difference between the predicted net pressure value for a cluster of fractures representing a dominant fracture and a predetermined net pressure value for a cluster of fractures representing another dominant fracture is within another predetermined margin of error, which represents a last updated treatment schedule; and performing the main fracture stimulation treatment stage based on the last updated treatment schedule.

In yet another embodiment, the present disclosure includes a non-transitory program carrier device tangibly carrying computer executable instructions for optimization of stimulation treatments for a main fracture stimulation treatment stage, the instructions being executable to implement: measuring values for i) a fluid flow allocation for each cluster of fractures associated with the main fracture stimulation treatment stage and a surface pressure profile during a step down test; and ii) tortuosity and friction pressure losses across each cluster of fractures after the step down test; calibrating a fracture model by iteratively simulating values for i) the fluid flow allocation for each cluster of fractures associated with the main fracture stimulation treatment stage and the surface pressure profile; and ii) the tortuosity and friction pressure losses across each cluster of fractures until a difference in the simulated values and the respective measured values is within a predetermined margin of error; simulating an initial treatment schedule for the main fracture stimulation treatment stage using the calibrated fracture model and one or more initial treatment schedule parameters; calculating a predicted net pressure value for each cluster of fractures using one of the simulated initial treatment schedule and an updated treatment schedule; updating the simulated initial treatment schedule until a difference between the predicted net pressure value for a cluster of fractures representing a dominant fracture and a predetermined net pressure value for a cluster of fractures representing another dominant fracture is within another predetermined margin of error, which represents a last updated treatment schedule; and performing the main fracture stimulation treatment stage based on the last updated treatment schedule.

While the present disclosure may be described with respect to stimulation treatments in a hydrocarbon reservoir, it is not limited thereto and may also be applied to other types of stimulation treatments (e.g., matrix acidizing treatments) to achieve similar results.

Referring now to FIG. 1, a schematic diagram illustrates an example of a well system 100 for performing a multistage stimulation treatment within a hydrocarbon reservoir formation. As shown in the example of FIG. 1, well system 100 includes a wellbore 102 in a subsurface formation 104 beneath a surface 106 of the wellsite. Wellbore 102 as shown in the example of FIG. 1 includes a lateral portion. However, it should be appreciated that embodiments are not limited thereto and that well system 100 may include any combination of lateral, vertical, slant, curved, and/or other wellbore orientations. The subsurface formation 104 in this example may include a reservoir that contains hydrocarbon resources, such as oil, natural gas, and/or others. For example, the subsurface formation 104 may be a rock formation (e.g., shale, coal, sandstone, granite, and/or others) that includes hydrocarbon deposits, such as oil and natural gas. In some cases, the subsurface formation 104 may be a tight gas formation that includes low permeability rock (e.g., shale, coal, and/or others). The subsurface formation 104 may be composed of naturally fractured rock and/or natural rock formations that are not fractured to any significant degree.

Well system 100 also includes a fluid injection system 108 for injecting treatment fluid, e.g., hydraulic fracturing fluid, into the subsurface formation 104 over multiple sections 118*a*, 118*b*, 118*c*, 118*d*, and 118*e* (collectively referred to herein as "sections 118") of the wellbore 102, as will be described in further detail below. Each of the sections 118 may correspond to, for example, a different stage or interval of the multistage stimulation treatment. The boundaries of the respective sections 118 and corresponding treatment stages/intervals along the length of the wellbore 102 may be delineated by, for example, the locations of bridge plugs, packers and/or other types of equipment in the wellbore 102. Additionally, or alternatively, the sections 118 and corresponding treatment stages may be delineated by particular features of the subsurface formation 104. Although five sections are shown in FIG. 1, it should be appreciated that any number of sections and/or treatment stages may be used as desired for a particular implementation. Furthermore, each of the sections 118 may have different widths or may be uniformly distributed along the wellbore 102.

As shown in FIG. 1, injection system 108 includes an injection control subsystem 111, a signaling subsystem 114 installed in the wellbore 102, and one or more injection tools 116 installed in the wellbore 102. The injection control subsystem 111 can communicate with the injection tools 116 from a surface 110 of the wellbore 102 via the signaling subsystem 114. Although not shown in FIG. 1, injection system 108 may include additional and/or different features for implementing the optimization techniques disclosed herein. For example, the injection system 108 may include any number of computing subsystems, communication subsystems, pumping subsystems, monitoring subsystems, and/or other features as desired for a particular implementation. In some implementations, the injection control subsystem 111 may be communicatively coupled to a remote computing system (not shown) for exchanging information via a network for purposes of monitoring and controlling wellsite operations, including operations related to the stimulation treatment. Such a network may be, for example and without limitation, a local area network, medium area network, and/or a wide area network, e.g., the Internet.

During each stage of the stimulation treatment, the injection system 108 may alter stresses and create a multitude of fractures in the subsurface formation 104 by injecting the treatment fluid into the surrounding subsurface formation 104 via a plurality of formation entry points along a portion of the wellbore 102 (e.g., along one or more of sections 118). The fluid may be injected through any combination of one or more valves of the injection tools 116. The injection tools 116 may include numerous components including, but not limited to, valves, sliding sleeves, actuators, ports, and/or other features that communicate treatment fluid from a working string disposed within the wellbore 102 into the subsurface formation 104 via the formation entry points. The formation entry points may include, for example, open-hole sections along an uncased portion of the wellbore path, a cluster of perforations along a cased portion of the wellbore path, ports of a sliding sleeve completion device along the wellbore path, slots of a perforated liner along the wellbore path, or any combination of the foregoing.

The injection tools 116 may also be used to perform diversion in order to adjust the downhole flow distribution of the treatment fluid across the plurality of formation entry points. Thus, the flow of fluid and delivery of diverter material into the subsurface formation 104 during the stimulation treatment may be controlled by the configuration of the injection tools 116. The diverter material injected into the subsurface formation 104 may be, for example, a degradable polymer. Examples of different degradable polymer materials that may be used include, but are not limited to, polysaccharides; lignosulfonates; chitins; chitosans; proteins; proteinous materials; fatty alcohols; fatty esters; fatty acid salts; aliphatic polyesters; poly(lactides); poly(glycolides); poly(ϵ-caprolactones); polyoxymethylene; polyurethanes, poly(hydroxybutyrates); poly(anhydrides); aliphatic polycarbonates; polyvinyl polymers; acrylic-based polymers poly(amino acids); poly(aspartic acid); poly(alkylene oxdies); poly(ethylene oxides); polyphosphazenes; poly(orthoesters); poly(hydroxy ester ethers); polyether esters, polyester amides; polyamides; polyhydroxyalkanoates; polyethyleneterephthalates; polybutyleneterephthalates; polyethylenenapthalenates; and copolymers, blends, derivatives, or combinations thereof. However, it should be appreciated that embodiments of the present disclosure are not intended to be limited thereto and that other types of diverter materials may also be used.

In one or more embodiments, the valves, ports, and/or other features of the injection tools 116 can be configured to control the location, rate, orientation, and/or other properties of fluid flow between the wellbore 102 and the subsurface formation 104. The injection tools 116 may include multiple tools coupled by sections of tubing, pipe, or another type of conduit. The injection tools may be isolated in the wellbore 102 by packers or other devices installed in the wellbore 102.

In some implementations, the injection system 108 may be used to create or modify a complex fracture network in the subsurface formation 104 by injecting fluid into portions of the subsurface formation 104 where stress has been altered. For example, the complex fracture network may be created or modified after an initial injection treatment has altered stress by fracturing the subsurface formation 104 at multiple locations along the wellbore 102. After the initial injection treatment alters stresses in the subterranean formation, one or more valves of the injection tools 116 may be selectively opened or otherwise reconfigured to stimulate, or re-stimulate, specific areas of the subsurface formation 104 along one or more sections 118 of the wellbore 102, taking advantage of the altered stress states to create complex fracture networks. In some cases, the injection system 108 may inject fluid simultaneously for multiple intervals and sections 118 of wellbore 102.

The operation of the injection tools 116 may be controlled by the injection control subsystem 111. The injection control subsystem 111 may include, for example, data processing equipment, communication equipment, and/or other systems that control injection treatments applied to the subsurface formation 104 through the wellbore 102. It should be appreciated that such control systems may be automated to enable the techniques disclosed herein to be performed without any user intervention. Additionally, or alternatively, the operation of one or more of these systems may be controlled at least partly based on input from a user via a user interface provided by the injection control subsystem 111, as will be described in further detail below with respect to FIG. 3.

In one or more embodiments, the injection control subsystem 111 may receive, generate, or modify a baseline treatment plan for implementing the various stages of the stimulation treatment along the path of the wellbore 102. The baseline treatment plan may specify a baseline pumping schedule for the treatment fluid injections and diverter deployments over each stage of the stimulation treatment. The baseline treatment plan may also specify initial or predetermined values for relevant parameters of the treatment fluid and diverter to be injected into the subsurface formation 104 during each treatment cycle and diversion phase, respectively, of each stage of the stimulation treatment. The parameters specified by such a baseline plan may include, for example, a pre-determined amount of diverter to be injected into the subsurface formation 104 during one or more diversion phases of the stimulation treatment. The predetermined diverter amount in this example may be based on historical data relating to the diverter usage during prior stimulation treatments performed along other wellbores drilled within the same hydrocarbon producing field. Additionally, or alternatively, the predetermined diverter amount may be based on the results of a computer simulation performed during a design phase of the treatment. In one or more embodiments, the predetermined diverter amount to be injected into the subsurface formation 104 may be adjusted based on the techniques described in further detail below.

In one or more embodiments, the injection control subsystem 111 initiates control signals to configure or reconfigure the injection tools 116 and/or other equipment (e.g., pump trucks, etc.) in real time based on the treatment plan or modified version thereof. During operation, the signaling subsystem 114 as shown in FIG. 1 transmits the signals from the injection control subsystem 111 at the wellbore surface 110 to one or more of the injection tools 116 disposed in the wellbore 102. For example, the signaling subsystem 114 may transmit hydraulic control signals, electrical control signals, and/or other types of control signals. The control signals may be reformatted, reconfigured, stored, converted, retransmitted, and/or otherwise modified as needed or desired en-route between the injection control subsystem 111 (and/or another source) and the injection tools 116 (and/or another destination). The transmitted signals thereby enable the injection control subsystem 111 to control the operation of the injection tools 116 while the treatment is in progress. Examples of different ways to control the operation of each of the injection tools 116 include, but are not limited to, opening, closing, restricting, dilating, repositioning, reorienting, and/or otherwise manipulating one or more valves of the tool to modify the manner in which treatment fluid, proppant, or diverter is communicated into the subsurface formation 104.

It should be appreciated that the combination of injection valves of the injection tools 116 may be configured or reconfigured at any given time during the stimulation treatment. It should also be appreciated that the injection valves may be used to inject any of various treatment fluids, proppants, and/or diverter materials into the subsurface formation 104. Examples of such proppants include, but are not limited to, sand, bauxite, ceramic materials, glass materials, polymer materials, polytetrafluoroethylene materials, nut shell pieces, cured resinous particulates comprising nut shell pieces, seed shell pieces, cured resinous particulars comprising seed shell pieces, fruit pit pieces, cured resinous particulates comprising fruit pit pieces, wood, composite particulates, lightweight particulates, microsphere plastic beads, ceramic microspheres, glass microspheres, manmade fibers, cement, fly ash, carbon black powder, and combinations thereof.

In some implementations, the signaling subsystem 114 transmits a control signal to multiple injection tools, and the control signal is formatted to change the state of only one or a subset of the multiple injection tools. For example, a shared electrical or hydraulic control line may transmit a control signal to multiple injection valves, and the control signal may be formatted to selectively change the state of only one (or a subset) of the injection valves. In some cases, the pressure, amplitude, frequency, duration, and/or other properties of the control signal determine which injection tool is modified by the control signal. In some cases, the pressure, amplitude, frequency, duration, and/or other properties of the control signal determine the state of the injection tool affected by the modification.

In one or more embodiments, the injection tools 116 may include one or more sensors for collecting data relating to downhole operating conditions and formation characteristics along the wellbore 102. Such sensors may serve as real-time data sources for various types of downhole measurements and diagnostic information pertaining to each stage of the stimulation treatment. Examples of such sensors include, but are not limited to, micro-seismic sensors, tiltmeters, pressure sensors, and other types of downhole sensing equipment. The data collected downhole by such sensors may include, for example, real-time measurements and diagnostic data for monitoring the extent of fracture growth and complexity within the surrounding formation along the wellbore 102 during each stage of the stimulation treatment, e.g., corresponding to one or more sections 118.

In one or more embodiments, the injection tools 116 may include fiber-optic sensors for collecting real-time measurements of acoustic intensity or thermal energy downhole during the stimulation treatment. For example, the fiber-optic sensors may be components of a distributed acoustic sensing (DAS), distributed strain sensing, and/or distributed temperature sensing (DTS) subsystems of the injection system 108. However, it should be appreciated that embodiments are not intended to be limited thereto and that the injection tools 116 may include any of various measurement and diagnostic tools. In some implementations, the injection tools 116 may be used to inject particle tracers, e.g., tracer slugs, into the wellbore 102 for monitoring the flow distribution based on the distribution of the injected particle tracers during the treatment. For example, such tracers may have a unique temperature profile that the DTS subsystem of the injection system 108 can be used to monitor over the course of a treatment stage.

In one or more embodiments, the signaling subsystem 114 may be used to transmit real-time measurements and diagnostic data collected downhole by one or more of the aforementioned data sources to the injection control subsystem 111 for processing at the wellbore surface 110. Thus, in the fiber-optics example above, the downhole data collected by the fiber-optic sensors may be transmitted to the injection control subsystem 111 via, for example, fiber optic cables included within the signaling subsystem 114. The injection control subsystem 111 (or data processing components thereof) may use the downhole data that it receives via the signaling subsystem 114 to perform real-time fracture mapping and/or real-time fracturing pressure interpretation using any of various data analysis techniques for monitoring stress fields around hydraulic fractures.

In one or more embodiments, the data analysis techniques performed by the injection control subsystem 111 may include a step-down test for identifying friction due to near-wellbore tortuosity (or "tortuosity friction") and other friction components of a total fracture entry friction along the wellbore 102. Such friction components may affect near-wellbore pressure loss during the stimulation treatment and thus, impact the effectiveness of the treatment along the wellbore 102. In one or more embodiments, the near-wellbore pressure loss may represent a difference between a bottom hole pressure and a bottom hole instantaneous shut-in pressure. Tortuosity friction in particular may be attributed to the path of fractures within the subsurface formation 104 relative to the wellbore's geometry. As will be described in further detail below, the friction components identified from the step-down test along with the fluid flow allocation for each cluster of fractures and a surface pressure profile obtained from surface pressure sensors may be used to calibrate a fracture model and simulate an initial treatment schedule for a main fracture stimulation treatment stage.

Figure 2A:
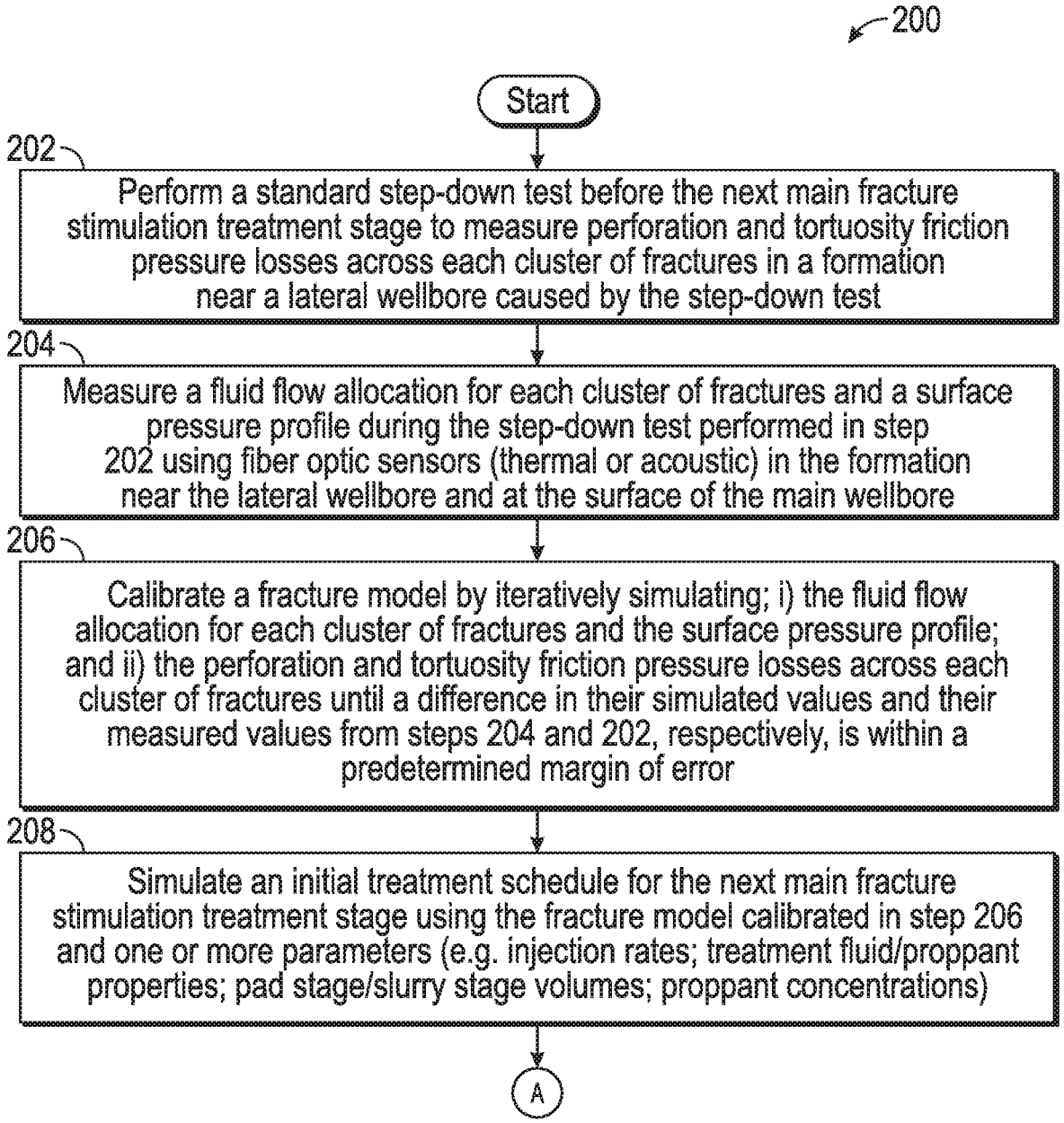
FIGS. 2A-2B are a flow diagram illustrating one embodiment of a method for implementing the present disclosure.
Figure 2B:
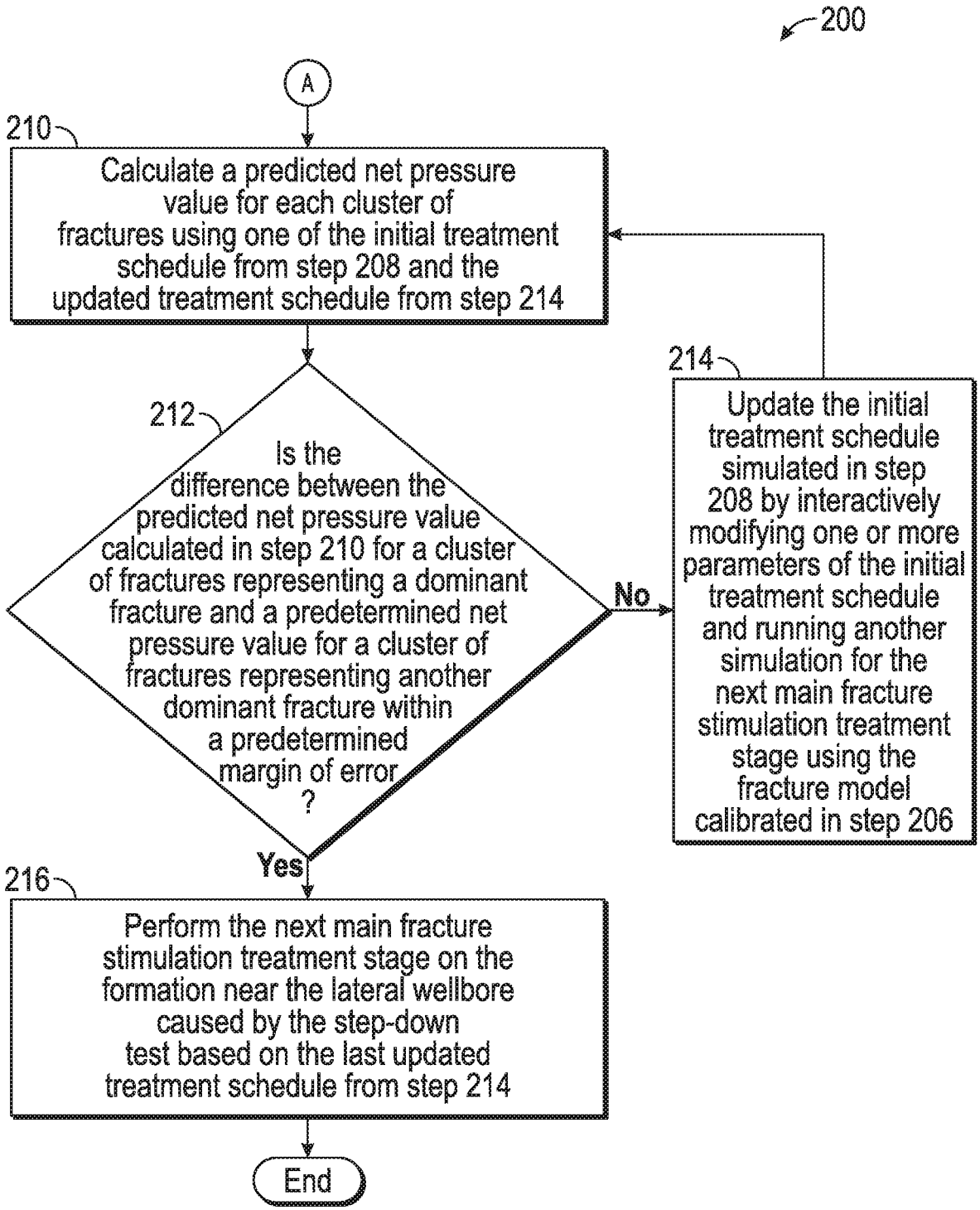

Referring now to FIGS. 2A-2B, a flow diagram illustrates one embodiment of a method 200 for implementing the present disclosure. The method 200 enables real-time optimization of stimulation treatments in a hydrocarbon reservoir by controlling a simulated stimulation treatment schedule for a main fracture stimulation treatment stage using a predicted net pressure in a cluster of fractures representing a dominant fracture for the main fracture stimulation treatment stage. The method 200 may be performed by the injection control subsystem 111 of the well system 100 in FIG. 1, as described above. Accordingly, the stimulation treatment in this example may be a multistage stimulation treatment, e.g., a multistage, hydraulic fracturing treatment. Each stage of the treatment may be conducted along a portion of a wellbore path within a subsurface formation, e.g., one or more sections 118 of the wellbore 102 within subsurface formation 104 of FIG. 1, as described above. The subsurface formation or portion thereof may be targeted as part of a treatment plan for stimulating the production of such resources from the rock formation. Accordingly, the method 200 may be used, for example, to optimize a pre-diverter stimulation treatment schedule for a main fracture stimulation treatment stage to achieve successful bridging and diversion.

In step 202, a standard step-down test is performed before the next main fracture stimulation treatment stage to measure perforation and tortuosity friction pressure losses across each cluster of fractures in a formation near a lateral wellbore caused by the step-down test.

In step 204, a fluid flow allocation for each cluster of fractures and a surface pressure profile is measured during the step-down test performed in step 202 using fiber optic sensors (thermal or acoustic) in the formation near the lateral wellbore and at the surface of the main wellbore.

In step 206, a fracture model is calibrated by iteratively simulating values for i) the fluid flow allocation for each cluster of fractures and the surface pressure profile; and ii) the perforation and tortuosity friction pressure losses across each cluster of fractures until a difference in their simulated values and their measured values from steps 204 and 202, respectively, is within a predetermined margin of error. Each simulation may be performed using the formation properties, well completion information, the step-down test schedule (rates and volumes) for performing the step-down test in step 202 and techniques well known in the art. In each iteration of the simulation, the perforation efficiency for each cluster of fractures may be modified until the difference in the simulated values and measured values for i) the fluid flow allocation for each cluster of fractures and the surface pressure profile; and ii) the perforation and tortuosity friction pressure losses across each cluster of fractures is within a predetermined margin of error. A predetermined margin of error is preferably less than or equal to 10% however, may be some other predefined percentage.

In step 208, an initial treatment schedule is simulated for the next main fracture stimulation treatment stage using the fracture model calibrated in step 206, one or more parameters (e.g. injection rates; treatment fluid/proppant properties; pad stage/slurry stage volumes; proppant concentrations) and techniques well-known in the art. The initial treatment schedule may include simulated fluid flow rates and fracture widths for each respective cluster of fractures. The cluster of fractures with the greatest flow rate and/or fracture width represents a dominant fracture.

In step 210, a predicted net pressure value is calculated for each cluster of fractures using one of the initial treatment schedule from step 208 and the updated treatment schedule from step 214, and techniques well-known in the art.

In step 212, the method 200 determines if the difference between the predicted net pressure value calculated in step 210 for a cluster of fractures representing a dominant fracture and a predetermined net pressure value for a cluster of fractures representing another dominant fracture is within a predetermined margin of error. A predetermined margin of error is preferably less than or equal to 10% however, may be some other predefined percentage. If the difference between the predicted net pressure value calculated in step 210 and the predetermined net pressure value is not within a predetermined margin of error, then the method 200 proceeds to step 214. Otherwise, the method 200 proceeds to step 216. The predetermined net pressure value for the cluster of fractures representing another dominant fracture may be determined using historical data from a successfully diverted main fracture stimulation treatment stage during a respective prior stimulation treatment. Alternatively, the predetermined net pressure value for the cluster of fractures representing another dominant fracture may be determined using an average of the historical data from multiple successfully diverted main fracture stimulation treatment stages during a respective multiple prior stimulation treatments. In either embodiment, each main fracture stimulation treatment stage, for purposes of determining the predetermined net pressure value, may be performed in the same lateral wellbore used to perform the next main fracture stimulation treatment stage or in a different lateral wellbore for the same well or a different well used to perform the next main fracture stimulation treatment stage. More particularly, the predetermined net pressure value for the cluster of fractures representing another dominant fracture may be determined by measuring a fluid flow allocation for each cluster of fractures and a surface pressure profile during the prior stimulation treatment(s) using fiber optic sensors (thermal or acoustic) in the formation near the lateral wellbore and at the surface of the corresponding main wellbore. A fracture model is then calibrated by iteratively simulating i) the fluid flow allocation for each cluster of fractures and the surface pressure profile; and ii) the perforation and tortuosity friction pressure losses across each cluster of fractures until a difference in their simulated values and their respectively measured values is within a predetermined margin of error. In each iteration of the simulation, the perforation efficiency for each cluster of fractures may be modified until the difference in the simulated values and their respectively measured values is within a predetermined margin of error. A predetermined margin of error is preferably less than or equal to 10% however, may be some other predefined percentage. Once calibrated, the fracture model simulated results may be used to determine the predetermined net pressure value for the cluster of fractures representing another dominant fracture.

Figure 3:
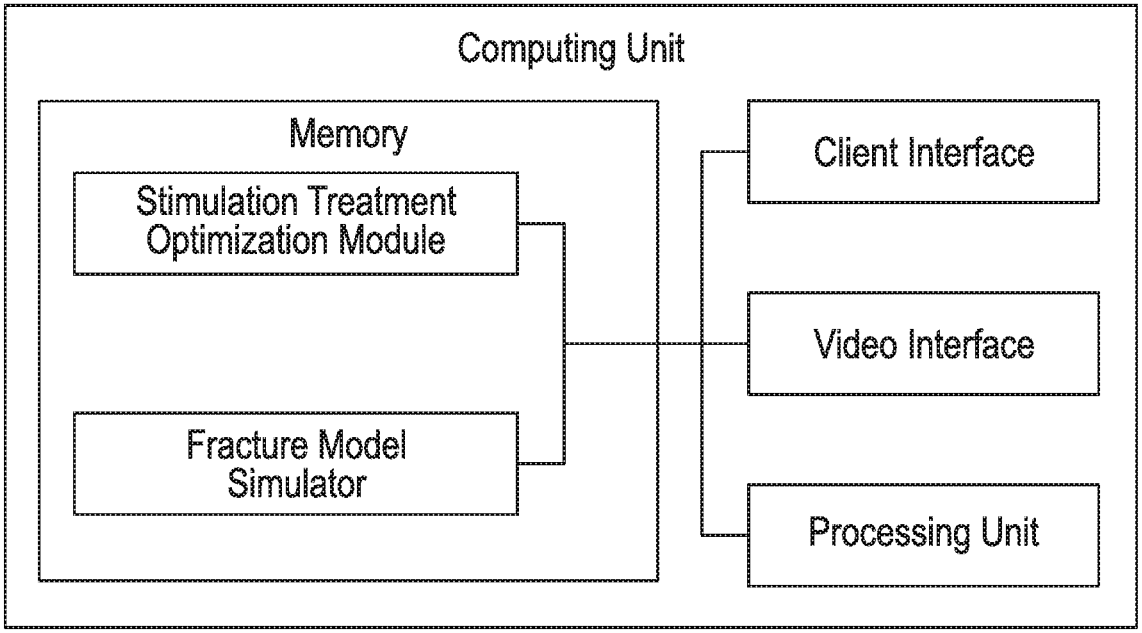
FIG. 3 is a block diagram illustrating one embodiment of a computer system for implementing the present disclosure

In step 214, the initial treatment schedule simulated in step 208 is updated by interactively modifying one or more parameters (e.g. injection rates; treatment fluid/proppant properties; pad stage/slurry stage volumes; proppant concentrations) of the initial treatment schedule using the client interface and/or the video interface described further in reference to FIG. 3 and running another simulation for the next main fracture stimulation treatment stage using the fracture model calibrated in step 206 and techniques well-known in the art. The method 200 returns the updated treatment schedule to step 210. Some embodiments for modifying the one or more parameters of the initial treatment schedule may include, but are not limited to: (1) decreasing the injection rate and pad stage volume if the predicted net pressure from step 210 is more than the predetermined net pressure; and (2) increasing the injection rate and pad stage volume if the predicted net pressure from step 210 is less than the predetermined net pressure.

In step 216, the next main fracture stimulation treatment stage is performed on the formation near the lateral wellbore caused by the step-down test based on the last updated treatment schedule from step 214.

The method 200 therefore, optimizes the pre-diverter stimulation treatment schedule for a main fracture stimulation treatment stage to achieve a desired net pressure inside the dominant fracture. By controlling the net pressure inside the dominant fracture, the width of the dominant fracture can be optimized to achieve successful bridging and diversion.

The present disclosure may be implemented through a computer-executable program of instructions, such as program modules, generally referred to as software applications or application programs executed by a computer. The software may include, for example, routines, programs, objects, components and data structures that perform particular tasks or implement particular abstract data types. The software forms an interface to allow a computer to react according to a source of input. A fracture model simulator software application may be used as an interface application to implement the present disclosure. The software may also cooperate with other code segments to initiate a variety of tasks in response to data received in conjunction with the source of the received data. The software may be stored and/or carried on any variety of memory such as CD-ROM, magnetic disk, bubble memory and semiconductor memory (e.g. various types of RAM or ROM). Furthermore, the software and its results may be transmitted over a variety of carrier media such as optical fiber, metallic wire and/or through any of a variety of networks, such as the Internet.

Moreover, those skilled in the art will appreciate that the disclosure may be practiced with a variety of computer-system configurations, including hand-held devices, multi-processor systems, microprocessor-based or programmable-consumer electronics, minicomputers, mainframe computers, and the like. Any number of computer-systems and computer networks are acceptable for use with the present disclosure. The disclosure may be practiced in distributed-computing environments where tasks are performed by remote-processing devices that are linked through a communications network. In a distributed-computing environment, program modules may be located in both local and remote computer-storage media including memory storage devices. The present disclosure may therefore, be implemented in connection with various hardware, software or a combination thereof, in a computer system or other processing system.

Referring now to FIG. 3, a block diagram illustrates one embodiment of a system for implementing the present disclosure on a computer. The system includes a computing unit, sometimes referred to as a computing system, which contains memory, application programs, a client interface, a video interface, and a processing unit. The computing unit is only one example of a suitable computing environment and is not intended to suggest any limitation as to the scope of use or functionality of the disclosure.

The memory primarily stores the application programs, which may also be described as program modules containing computer-executable instructions, executed by the computing unit for implementing the present disclosure described herein and illustrated in FIGS. 1-2. The memory therefore, includes a stimulation treatment optimization module, which enables steps 206-214 described in reference to FIGS. 2A-2B. The stimulation treatment optimization module may integrate functionality from the remaining application programs illustrated in FIG. 3. In particular, the fracture model simulator may be used as an interface application to perform the simulation in steps 206-208 and 214. Although the fracture model simulator may be used as interface application, other interface applications may be used, instead, or the stimulation treatment optimization module may be used as a stand-alone application.

Although the computing unit is shown as having a generalized memory, the computing unit typically includes a variety of computer readable media. By way of example, and not limitation, computer readable media may comprise computer storage media and communication media. The computing system memory may include computer storage media in the form of volatile and/or nonvolatile memory such as a read only memory (ROM) and random access memory (RAM). A basic input/output system (BIOS), containing the basic routines that help to transfer information between elements within the computing unit, such as during start-up, is typically stored in ROM. The RAM typically contains data and/or program modules that are immediately accessible to, and/or presently being operated on, the processing unit. By way of example, and not limitation, the computing unit includes an operating system, application programs, other program modules, and program data.

The components shown in the memory may also be included in other removable/nonremovable, volatile/nonvolatile computer storage media or they may be implemented in the computing unit through an application program interface ("API") or cloud computing, which may reside on a separate computing unit connected through a computer system or network. For example only, a hard disk drive may read from or write to nonremovable, nonvolatile magnetic media, a magnetic disk drive may read from or write to a removable, nonvolatile magnetic disk, and an optical disk drive may read from or write to a removable, nonvolatile optical disk such as a CD ROM or other optical media. Other removable/nonremovable, volatile/nonvolatile computer storage media that can be used in the exemplary operating environment may include, but are not limited to, magnetic tape cassettes, flash memory cards, digital versatile disks, digital video tape, solid state RAM, solid state ROM, and the like. The drives and their associated computer storage media discussed above provide storage of computer readable instructions, data structures, program modules and other data for the computing unit.

A client may enter commands and information into the computing unit through the client interface, which may be input devices such as a keyboard and pointing device, commonly referred to as a mouse, trackball or touch pad. Input devices may include a microphone, joystick, satellite dish, scanner, or the like. These and other input devices are often connected to the processing unit through the client interface that is coupled to a system bus, but may be connected by other interface and bus structures, such as a parallel port or a universal serial bus (USB).

A monitor or other type of display device may be connected to the system bus via an interface, such as a video interface. A graphical user interface ("GUI") may also be used with the video interface to receive instructions from the client interface and transmit instructions to the processing unit. In addition to the monitor, computers may also include other peripheral output devices such as speakers and printer, which may be connected through an output peripheral interface.

Although many other internal components of the computing unit are not shown, those of ordinary skill in the art will appreciate that such components and their interconnection are well-known.

While the present disclosure has been described in connection with presently preferred embodiments, it will be understood by those skilled in the art that it is not intended to limit the disclosure to those embodiments. It is therefore, contemplated that various alternative embodiments and modifications may be made to the disclosed embodiments without departing from the spirit and scope of the disclosure defined by the appended claims and equivalents thereof.

The invention claimed is:

1. A method for optimization of stimulation treatments for a main fracture stimulation treatment stage, which comprises:

measuring values for i) a fluid flow allocation for each cluster of fractures associated with the main fracture stimulation treatment stage using fiber optic sensors and a surface pressure profile; and ii) tortuosity and friction pressure losses across each cluster of fractures;

calibrating a fracture model by iteratively simulating values for i) the fluid flow allocation for each cluster of fractures associated with the main fracture stimulation treatment stage and the surface pressure profile; and ii) the tortuosity and friction pressure losses across each cluster of fractures until a difference in the simulated values and the respective measured values is within a predetermined margin of error;

simulating an initial treatment schedule for the main fracture stimulation treatment stage using the calibrated fracture model and one or more initial treatment schedule parameters;

calculating a predicted net pressure value for each cluster of fractures using one of the simulated initial treatment schedule and an updated treatment schedule;

updating the simulated initial treatment schedule until a difference between the predicted net pressure value for a cluster of fractures representing a dominant fracture and a predetermined net pressure value for a cluster of fractures representing another dominant fracture is within another predetermined margin of error, which represents a last updated treatment schedule; and performing the main fracture stimulation treatment stage based on the last updated treatment schedule.

2. The method of claim 1, wherein the measured values for the fluid flow allocation for each cluster of fractures and the surface pressure profile are measured during a step down test.

3. The method of claim 1, wherein the measured values for the tortuosity and friction pressure losses across each cluster of fractures are measured after a step down test.

4. The method of claim 1, wherein the predetermined margin of error and the another predetermined margin of error are less than or equal to 10%.

5. The method of claim 1, wherein the one or more initial treatment schedule parameters include at least one of an injection rate, a fluid property, a proppant property, a pad stage volume, a slurry stage volume, and a proppant concentration.

6. The method of claim 1, wherein the predetermined net pressure value is determined using historical data from another main fracture stimulation treatment stage that is successfully diverted during a respective prior stimulation treatment.

7. The method of claim 6, wherein the another main fracture stimulation treatment stage is performed in a lateral wellbore used to perform the main fracture stimulation treatment stage.

8. The method of claim 6, wherein the another main fracture stimulation treatment stage is performed in lateral wellbore that is not used to perform the main fracture stimulation treatment stage.

9. The method of claim 1, wherein the simulated initial treatment schedule is updated by iteratively modifying the one or more initial treatment schedule parameters and running another simulation for the main fracture stimulation treatment stage using the calibrated fracture model.

10. A non-transitory program carrier device for tangibly carrying computer executable instructions for optimization of stimulation treatments for a main fracture stimulation treatment stage, the instructions being executable to implement:

measuring values for i) a fluid flow allocation for each cluster of fractures associated with the main fracture stimulation treatment stage using fiber optic sensors and a surface pressure profile; and ii) tortuosity and friction pressure losses across each cluster of fractures;

calibrating a fracture model by iteratively simulating values for i) the fluid flow allocation for each cluster of fractures associated with the main fracture stimulation treatment stage and the surface pressure profile; and ii) the tortuosity and friction pressure losses across each cluster of fractures until a difference in the simulated values and the respective measured values is within a predetermined margin of error;

simulating an initial treatment schedule for the main fracture stimulation treatment stage using the calibrated fracture model and one or more initial treatment schedule parameters;

calculating a predicted net pressure value for each cluster of fractures using one of the simulated initial treatment schedule and an updated treatment schedule;

updating the simulated initial treatment schedule until a difference between the predicted net pressure value for a cluster of fractures representing a dominant fracture and a predetermined net pressure value for a cluster of fractures representing another dominant fracture is within another predetermined margin of error, which represents a last updated treatment schedule; and performing the main fracture stimulation treatment stage based on the last updated treatment schedule.

11. The program carrier device of claim 10, wherein the measured values for the fluid flow allocation for each cluster of fractures and the surface pressure profile are measured during a step down test.

12. The program carrier device of claim 10, wherein the measured values for the tortuosity and friction pressure losses across each cluster of fractures are measured after a step down test.

13. The program carrier device of claim 10, wherein the predetermined margin of error and the another predetermined margin of error are less than or equal to 10%.

14. The program carrier device of claim 10, wherein the one or more initial treatment schedule parameters include at least one of an injection rate, a fluid property, a proppant property, a pad stage volume, a slurry stage volume, and a proppant concentration.

15. The program carrier device of claim 10, wherein the predetermined net pressure value is determined using historical data from another main fracture stimulation treatment stage that is successfully diverted during a respective prior stimulation treatment.

16. The program carrier device of claim 15, wherein the another main fracture stimulation treatment stage is performed in a lateral wellbore used to perform the main fracture stimulation treatment stage.

17. The program carrier device of claim 15, wherein the another main fracture stimulation treatment stage is performed in lateral wellbore that is not used to perform the main fracture stimulation treatment stage.

18. The program carrier device of claim 10, wherein the simulated initial treatment schedule is updated by iteratively modifying the one or more initial treatment schedule parameters and running another simulation for the main fracture stimulation treatment stage using the calibrated fracture model.

19. A non-transitory program carrier device for tangibly carrying computer executable instructions for optimization of stimulation treatments for a main fracture stimulation treatment stage, the instructions being executable to implement:

measuring values for i) a fluid flow allocation for each cluster of fractures associated with the main fracture stimulation treatment stage and a surface pressure profile during a step down test; and ii) tortuosity and friction pressure losses across each cluster of fractures after the step down test;

calibrating a fracture model by iteratively simulating values for i) the fluid flow allocation for each cluster of fractures associated with the main fracture stimulation treatment stage and the surface pressure profile; and ii) the tortuosity and friction pressure losses across each cluster of fractures until a difference in the simulated values and the respective measured values is within a predetermined margin of error;

simulating an initial treatment schedule for the main fracture stimulation treatment stage using the calibrated fracture model and one or more initial treatment schedule parameters;

calculating a predicted net pressure value for each cluster of fractures using one of the simulated initial treatment schedule and an updated treatment schedule;

updating the simulated initial treatment schedule until a difference between the predicted net pressure value for a cluster of fractures representing a dominant fracture and a predetermined net pressure value for a cluster of fractures representing another dominant fracture is within another predetermined margin of error, which represents a last updated treatment schedule; and performing the main fracture stimulation treatment stage based on the last updated treatment schedule.

20. The program carrier device of claim 19, wherein the simulated initial treatment schedule is updated by iteratively modifying the one or more initial treatment schedule parameters and running another simulation from the main fracture stimulation treatment stage using the calibrated fracture model.

* * * * *